United States Patent [19]

Driscoll

[11] 4,068,600

[45] Jan. 17, 1978

[54] TABLE ASSEMBLY OF MOLDED PLASTICS MATERIAL

[76] Inventor: James R. Driscoll, 404 Winston Ave., Dayton, Ohio 45403

[21] Appl. No.: 731,363

[22] Filed: Oct. 12, 1976

[51] Int. Cl.[2] ..... A47B 3/06

[52] U.S. Cl. ..... 108/111; 108/156

[58] Field of Search ..... 108/154, 111, 101, 156, 108/91, 53.5; 211/126

[56] References Cited

U.S. PATENT DOCUMENTS

| | | | |
|---|---|---|---|
| 1,312,891 | 8/1919 | Carlin | 108/111 |
| 1,572,003 | 2/1926 | Fleming | 108/156 |
| 1,800,456 | 4/1931 | Lawrence | 108/156 |
| 2,474,668 | 6/1949 | Herbolsheimer | 108/154 X |
| 2,573,304 | 10/1951 | Bronstein | 108/154 |
| 2,873,035 | 2/1959 | Unis | 108/111 |
| 2,936,078 | 5/1960 | Ziegler | 108/111 X |
| 2,982,424 | 5/1961 | Van Syoc | 108/111 |
| 3,655,065 | 4/1972 | Yellin | 108/151 X |
| 3,834,324 | 9/1974 | Lang | 108/111 X |
| 3,875,873 | 4/1975 | Howitt | 108/156 X |

*Primary Examiner*—Francis K. Zugel
*Attorney, Agent, or Firm*—Jacox & Meckstroth

[57] ABSTRACT

A pair of upper and lower tray members are molded of a rigid plastics material, and each tray member includes a peripherally extending rim portion from which depends a peripherally extending skirt portion. The corner portions of the tray members are rounded, and a set of correspondingly curved leg members support the corner portions of the tray members. The leg members are also molded of a plastics material, and each leg member includes a support portion which engages and supports the skirt portion of each tray member. Each leg member also has a set vertically spaced integral flange portions which project inwardly under the tray members, and the flange portions have openings for receiving corresponding bosses projecting downwardly from the underneath sides of the tray members. The flange portions are slightly flexible to provide for snap-fitting the leg members onto the tray members to produce a rigid and sturdy table assembly.

9 Claims, 3 Drawing Figures

TABLE ASSEMBLY OF MOLDED PLASTICS MATERIAL

BACKGROUND OF THE INVENTION

Various different table assemblies have been constructed to simplify the assembly of separate components such as a set of vertically spaced platforms or tray members which are connected by corner support legs. For example, U.S. Pat. No. 2,677,470 discloses a rectangular metal table having upper and lower shelves or tray members each of which is provided with corner angle sockets. The sockets receive a set of corner angle support legs which permit the table to be easily assembled and disassembled without screws, bolts or other fasteners.

It has been found desirable to construct the components of a table of a molded plastics material in order to minimize the cost and weight of the table and to eliminate problems of corrosion. However, problems are encountered in obtaining a plastic table assembly which has high strength and rigidity in addition to high durability.

SUMMARY OF THE INVENTION

The present invention is directed to an improved table assembly constructed of interfitting components which are each adapted to be efficiently molded of a substantially rigid plastics material. In the illustrated embodiment, the table assembly includes a set of molded plastic identical tray members which are supported in vertically spaced relation by a set of molded plastic corner leg members which are also of identical construction. The leg members are constructed to interfit and snap-fit onto the tray members in a manner which provides for a table having high strength, rigidity and durability and which can be quickly and easily assembled and disassembled.

Other features and advantages of a table constructed in accordance with the invention will be apparent from the following description, the accompanying drawing and the appended claims.

DESCRIPTION OF THE PREFERRED EMBODIMENT

Figure 1:
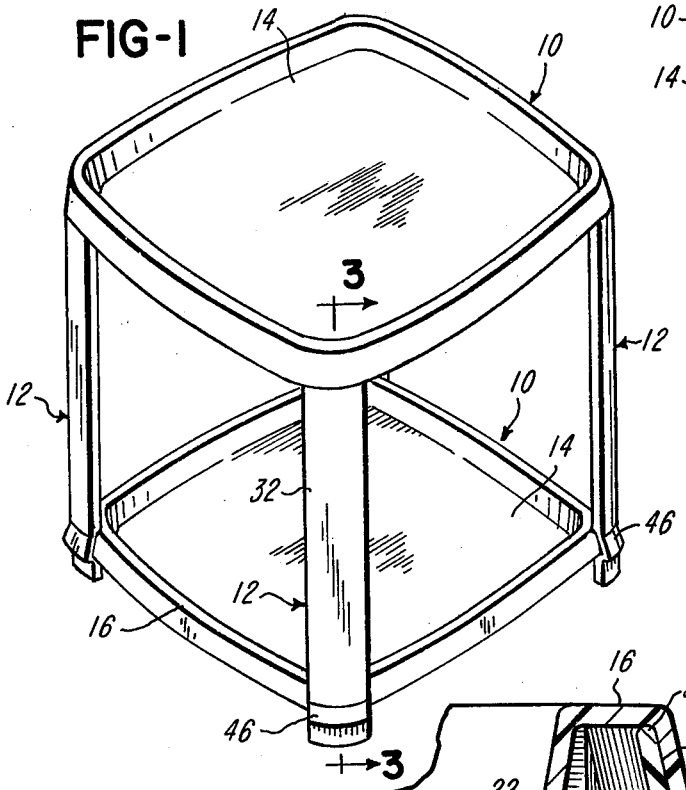
FIG. 1 is a perspective view of a table constructed and assembled in accordance with the invention.

Referring to the drawing, a pair of generally square or rectangular upper and lower tray members 10 are interconnected and supported in vertically spaced relation by a set of corner leg members 12. Each of the tray members 10 and leg members 12 is formed by injection molding a thermoplastics material such as an "ABS" material. Each of the tray members 10 includes a generally horizontal flat base or bottom wall portion 14 which is integrally connected to a peripherally extending rim portion 16 by a peripherally extending inclined inner wall portion 17. An integrally formed or molded outer wall or skirt portion 18 projects downwardly or depends from the rim portion 16 and terminates with a bottom edge located substantially level with the upper surface of the supporting base wall portion 14.

Figure 2:
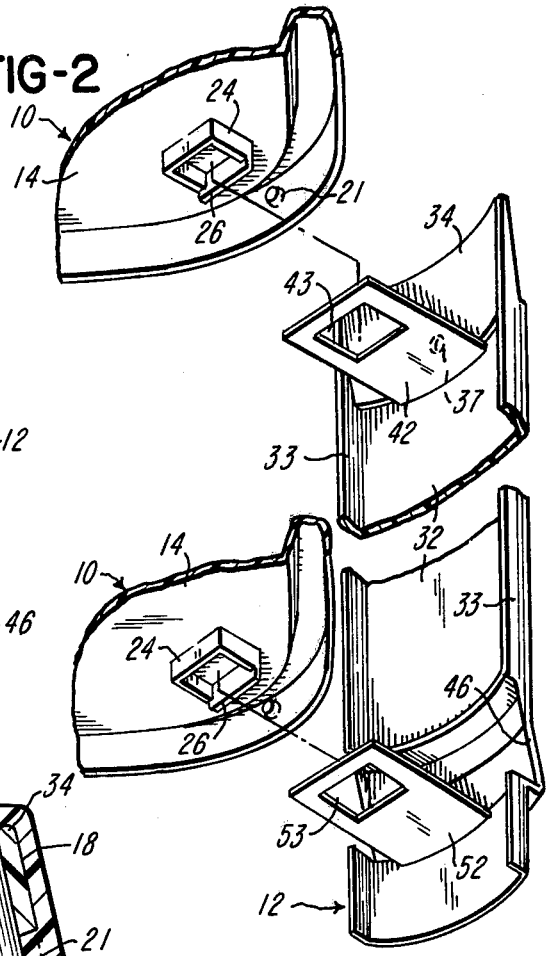
FIG. 2 is an exploded bottom perspective view of a corner section of the table assembly shown in FIG. 1 and with a center portion of the leg member broken away.

As illustrated in FIGS. 1 and 2, the corner portions of each tray member 10 are rounded or curved, and an integrally molded stud or projection 21 protrudes inwardly from each corner of the skirt portion 18 and into the peripherally extending and downwardly open cavity 22 formed by the wall portions 16, 17 and 18 of each tray member. Each corner portion of each tray member 10 also includes an integrally molded frame-like rectangular boss or projection 24 which protrudes downwardly from the bottom or base wall portion 14 of the tray member. The outer wall of each projection 24 extends slightly downwardly from the remaining walls of the projection to form an extended lip portion 26.

Figure 3:
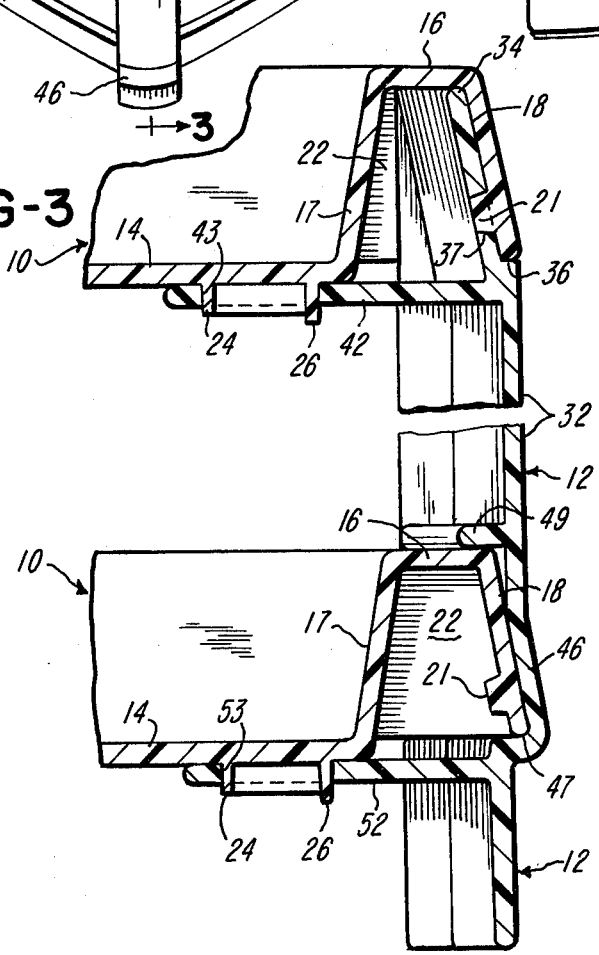
FIG. 3 is an enlarged vertical section of a corner portion of the assembled table as taken generally on the line 3—3 of FIG. 1 and also having the center portion of the leg member removed.

As shown in the drawing, each of the leg members 12 includes a curved outer wall 32 which conforms to the curvature of the corners of the tray members 10, and the outer wall 32 integrally connects vertically extending side walls or flanges 33 to form a curved channel-like horizontal cross-sectional configuration. Each of the leg members 12 also includes an upper end or lip portion 34 which conforms to the curvature of the corner so that the lip portion 34 engages the inner surface of the corresponding corner skirt portion 18, as shown in FIG. 3. The lip portion 34 is offset inwardly to form an outer shoulder 36 which receives and supports the lower end surface of the corner skirt portion 18, and a hole or opening 37 is formed within the lip portion 34 for receiving the stud or projection 21 which is molded as an integral part of the skirt portion 18.

Each leg member 12 has a generally horizontal and integrally formed upper flange portion 42 which projects inwardly adjacent the bottom surface of the base wall portion 14 of the upper tray member 10, and the flange portion 42 has a rectangular opening 43 for receiving the corresponding frame-like projection 24 in close fitting relation.

The lower part of each leg member 12 includes an outwardly projecting curved wall portion 46 which defines a cavity for receiving the corresponding corner of the skirt portion 18, as illustrated in FIG. 3. The wall portion 46 forms an inner horizontal shoulder 47 which supports the bottom edge of the corner skirt portion 18, and an integrally molded horizontal flange portion 49 projects inwardly adjacent the top surface of the rim portion 16 of the lower tray member 10.

Each of the leg members 12 is also molded with an integral lower flange portion 52 which is substantially identical in configuration to the upper flange portion 42. The lower flange portion 52 also has a rectangular opening 53 for receiving the corresponding frame-like projection 24 protruding from the lower surface of the base wall portion 14 of the lower tray member 10. Each of the flange portion 42 and 52 is slightly springy and may be flexed relative to the vertical wall portion of the leg member 12 in order to engage and release the corresponding projection 24.

The assembly of the tray members 10 and the leg members 12 is accomplished by preferably placing the upper tray member 10 upside down on a floor or other support surface. The lip portion 34 of one of the leg members 12 is then inserted into a corner of the cavity 22 and adjacent the inner surface of the skirt portion 18 so that the projection 21 extends into the adjacent hole 37 to prevent relative vertical movement of the tray and leg members. The leg member is then tilted to a vertical position so that the upper flange portion 42 receives the corresponding rectangular projection 24, thereby preventing relative horizontal movement between the leg and tray members.

The bottom tray member 10 is then inverted and a corner portion of the tray member is hooked into the cavity formed by the wall portion 46 of the inverted upright leg member 12. The flange portion 52 is snap-fitted onto the adjacent rectangular projection 24 so that the one leg member is rigidly connected or locked to both of the tray members 10. The remaining three leg members are successivly inserted and snap-fitted onto the tray members 10 while the tray members remain in the inverted positions. After all of these leg members are connected, the table assembly is completed and is inverted so that it is ready for use. The disassemble the table assembly, the above procedure is merely reversed. That is, the lower flange portion 52 of each leg member 12 is flexed slightly so that it is released from the corresponding projection 24, after which the leg member is tilted outwardly and removed from both tray members.

From the drawing of the above description, it is apparent that a table assembly constructed in accordance with the present invention, provides desirable features and advantages. For example, the connections of the curved lip portion 34 and wall portion 46 of each leg member 12 with the adjacent curved skirt portions 18 of the upper and lower tray members 10, are effective to prevent relative vertical movement between each leg member 12 and the tray member 10. Similarly, the connections of the flange portions 42 and 52 of each leg member 12 with the corresponding projections 24 of the tray members 10, form positive locks which prevent relatively horizontal movement and rotation between the leg members 12 and the tray members 10.

These connections of the leg and tray members cooperate with the curved channel-like configuration of the leg members to provide for a positive, rigid and sturdy table assembly which also has high support strength. Furthermore, the construction of the tray members 10 and the leg members 12 provide for a quick and easy assembly and dissassembly of the table unit. In addition, the all plastic construction of the table assembly eliminates any problem of corrosion and provides for easy cleaning.

While the form of table assembly herein described constitutes a preferred embodiment of the invention, it is to be understood that the invention is not limited to this precise form of table assembly, and that changes may be made therein without departing from the scope and spirit of the invention as defined in the appended claims.

The invention having thus been described, the following is claimed:

1. A table assembly adapted to be conveniently and quickly erected, comprising a tray member including a generally horizontal bottom wall portion integrally connected to an upwardly projecting peripheral rim portion, said rim portion including a downwardly projecting skirt portion and having generally an inverted U-shaped cross-sectional configuration to define an open bottom peripheral cavity, a plurality of peripherally spaced leg members each including an upper lip portion projecting upwardly into said cavity and engaging said skirt portion of said tray member, means connecting said lip portion of each leg member to said skirt portion of said tray member for limiting relative vertical movement between said tray and leg members, each said leg member including an integral generally horizontal flange portion projecting inwardly from generally the base of said lip portion under said bottom wall portion of said tray member, snap-type latch means connecting said bottom wall portion of said tray member with said flange portion of each said leg member to limit relative horizontal movement between said tray member and each said leg member, and said inwardly projecting flange portion of each said leg member being slightly flexible relative to said lip portion of said leg member to effect connection of each said latch means.

2. A table assembly as defined in claim 1 wherein each said latch means connecting said flange portion of each said leg member with said bottom wall portion of said tray member comprise a boss projecting downwardly from said bottom wall portion of said tray member, and said flange portion of said leg member includes means defining an opening for receiving said boss.

3. A table assembly as defined in claim 1 wherein each said leg member includes means forming a generally horizontal external shoulder disposed generally at the base of each said lip portion for engaging and supporting the lower edge of said skirt portion of said tray member.

4. A table assembly as defined in claim 1 wherein said tray and leg members each comprises a one-piece component of molded plastics material, said skirt portion of said tray member has a corresponding plurality of rounded outer corner portions, said lip portion of each said leg member is correspondingly curved to mate with the inner surface of the corresponding outer corner portion, and said lip portion of each said leg member has an opening for receiving an integral projection on the corresponding corner portion.

5. A table assembly as defined in claim 1 including a lower said tray member spaced below the upper said tray member, each of said leg members further includes a generally horizontal integral lower flange portion projecting inwardly under said bottom wall portion of said lower tray member, and corresponding said latch means for connecting each said lower flange portion to said bottom wall portion of said lower tray member.

6. A table assembly adapted to be conveniently and quickly erected, comprising a set of vertically spaced tray members each including a generally horizontal bottom wall portion integrally connected to an upwardly projecting peripheral rim portion, said rim portion of each said tray member including a downwardly projecting skirt portion and having generally an inverted U-shaped cross-sectional configuration to define an open bottom peripheral cavity, a plurality of peripherally spaced leg members each including an upper lip portion projecting upwardly into said cavity of the upper said tray member and engaging said skirt portion of said tray member, means connecting said lip portion of each leg member to said skit portion of the upper said tray member for limiting relative vertical movement between the upper said tray and leg members, each said leg member including a portion confining said skirt portion of the lower said tray member for limiting relative vertical movement, each said leg member further including a set of vertically spaced generally horizontal flange portions projecting inwardly under said bottom wall portions of the corresponding said tray members, snap-type latch means connecting said bottom wall portion of each said tray member with the corresponding said flange portion of each said leg member to limit relative horizontal movement between said tray members and each said leg member, and each said inwardly projecting flange portion of each said leg member being slightly flexible relative to an adjacent portion of said leg member to effect connection of each said latch means.

7. A table assembly as defined in claim 6 wherein each said latch means connecting each said flange portion of each said leg member with the corresponding said bottom wall portion of each said tray member comprise a boss projecting downwardly from said bottom wall portion of said tray member, and each said flange portion of each said leg member includes means defining an opening for receiving said boss.

8. A table assembly as defined in claim 7 wherein said opening within each said flange portion has a generally rectangular configuration.

9. A table assembly as defined in claim 7 wherein said opening within each said flange portion has a generally rectangular configuration.

* * * * *